United States Patent [19]

Milano

[11] Patent Number: 4,473,061

[45] Date of Patent: Sep. 25, 1984

[54] COMBINED GRATE AND HOT WATER HEATER

[76] Inventor: Enrico Milano, 8 Lake Shore Dr., Hudson, Mass. 01749

[21] Appl. No.: 422,090

[22] Filed: Sep. 23, 1982

[51] Int. Cl.[3] ..... F24B 9/04

[52] U.S. Cl. ..... 126/132; 126/164

[58] Field of Search ..... 126/132, 164, 126, 120, 126/134; 122/20 B; 237/8 R, 19, 56, 51

[56] References Cited

U.S. PATENT DOCUMENTS

| | | | |
|---|---|---|---|
| 670,066 | 3/1901 | Smoak | 126/132 |
| 1,576,899 | 3/1926 | Clanton | 126/132 |
| 4,140,102 | 2/1979 | Malecki | 126/164 |
| 4,161,168 | 7/1979 | Cagle | 126/164 |
| 4,163,442 | 8/1979 | Welty | 126/164 |
| 4,178,908 | 12/1979 | Trexler | 126/121 |
| 4,180,053 | 12/1979 | Patel | 126/132 |
| 4,191,163 | 3/1980 | Ballard | 126/132 |
| 4,203,417 | 5/1980 | Boyd | 126/165 |
| 4,204,519 | 5/1980 | Towery | 126/164 |
| 4,215,671 | 8/1980 | Nadolsky | 126/164 |
| 4,228,784 | 10/1980 | Malogouris | 126/121 |
| 4,257,557 | 3/1981 | Thomasina | 126/132 |
| 4,258,880 | 3/1981 | Williamson | 126/132 |
| 4,330,083 | 5/1982 | Di Fiore | 126/132 |

*Primary Examiner*—James C. Yeung

*Attorney, Agent, or Firm*—Irving M. Kriegsman

[57] ABSTRACT

A combined grate and hot water heater for a fireplace which can be easily fabricated using conventional parts, easily installed and easily used is disclosed. The combined grate and hot water heater includes a rectangular shaped cradle for holding combustible materials to be burned which is sized and configured to fit into the fire chamber of the fireplace and a set of supporting legs for supporting the cradle on the floor of the fire chamber in spaced apart relationship. The cradle is made of a plurality of longitudinally extending and laterally extending heavy duty cast iron pipes interconnected by suitable pipe couplings so as to be in fluid communication with one another. A water inlet pipe and a water outlet pipe are connected to and in fluid communication with the pipes in the cradle for supplying water to be heated into the pipes and then allowing exit of the water after it has circulated through the pipes and has been heated by the fire produced on burning of the combustible materials. An inverted U shaped pipe section also made of heavy duty cast iron is coupled in fluid communication with the pipes in the cradle and extends vertically upward into the flue of the fireplace to utilize the heat present in the flue to further heat the water circulated through the pipes.

4 Claims, 2 Drawing Figures

COMBINED GRATE AND HOT WATER HEATER

BACKGROUND OF THE INVENTION

The present invention relates to a combined grate and hot water heater for use in a fireplace.

It is to be noted that although the invention will be described hereinafter for use in a fireplace, it may also be used in a wood burning stove or other similar structure and is therefore not intended to be limited to use solely with a fireplace. Accordingly, for simplicity, the term "fireplace" as used hereinafter is intended to include wood burning stoves and other similar structures.

In recent years a number of devices have been either proposed or actually constructed for the purpose of extracting useful heat generated in a fireplace. Some of these devices have been designed to utilize the heat present in a fireplace to heat air that is forced through the fire chamber in the fireplace, the resulting hot air being used for home heating purposes while other devices have been designed to heat water that is passed through the fire chamber, the resulting hot water being used for heating purposes or consumption.

Unfortunately, for the most part such devices have been very costly to manufacture, very difficult to install and/or not very efficient in their operation.

In U.S. Pat. No. 4,191,163 to H. G. Ballard there is disclosed a water heater for a fireplace having a fire chamber defined by a hearth, rear and side walls, and a top wall containing a flue comprising a lower U-shaped header consisting of heater pipes extending adjacent respective rear and side walls within said fire chamber defining an open area for building a fire so that the hearth is entirely open about a central portion thereof to accommodate a fire supported therein entirely apart from the heater, an upper heater extending adjacent a marginal portion of said top wall about the flue; a plurality of upright boiler pipes connecting said lower and upper headers spaced along said rear and side walls; a first number of said boiler pipes along said rear wall extending substantially vertically upwardly from said lower header connecting with a rear portion of said upper header and a second number of said boiler pipes alternating with said first number extending diagonally across said fire chamber connecting with a front portion of said upper head simultaneously communicating water flow from said lower header with said front and rear portions of said upper header enhancing efficient transfer of heat; and connections for supplying water to flow through said water heater.

In U.S. Pat. No. 4,180,053 to H. Patel there is disclosed an apparatus for installation in a domestic fireplace to cover waste heat from a fire therein, comprising, a coil of tubing in the form of a spiral of several turns mounting structure for supporting the coil within said fire place above the floor thereof, with the axis of the coil oriented horizontally and directed toward the front of the fireplace, said coil presenting an opening at the front end thereof of such diameter that fuel can be introduced through the opening into the interior of the coil from the front of the fireplace, the lower portions of the turns of said coil consisting of support means to hold said fuel for burning in the interior of said coil, the upper portions of the turns of said coil passing above the lower portions thereof so that air heated by fuel disposed within said coil rises to said upper portions, means for circulating liquid through said coil, to be heated by the burning of said fuel, and a semi-cylindrical hood, being positioned closely above the upper portions turns to slow the movement of hot air from a fire interior of said coil, past the upper portions, said hood having a front end closure which extends downward across the upper part of said opening at the front of said coil, thereby to block forward escape of smoke within said hood, said hood being open at the back of said coil to permit the escape of smoke thereunder to the rear of said fireplace.

In U.S. Pat. No. 4,204,519, to M. W. Towery there is disclosed a forced hot air wood burning fireplace attachment including a blower, a header communicating with the blower and a plurality of generally C-shaped tubes each having one end connected to the header. The other end of the tubes facing away from the fireplace and towards a room to be heated and a at least one of these ends having connected thereto a bypass conduit for delivering air directly to the fire.

In U.S. Pat. No. 4,203,417 to D. A. Boyd there is disclosed a fireplace heater and grate comprising a series of vertically extending laterally spaced convection tubes having portions at their lower ends for passage therethrough of unheated air, and a rectangular grate of basket-like configuration for containing coal or like fuel for providing a fire for heating the air in said tube portions. The tube portions extend through the grate in heat-exchanging relationship with said fuel. Cast iron shields are provided which overlie and are in contact with said tube portions for protecting said tube portions from the corrosive and burning effects of said burning fuel. The shields are of semi-circular cross-section and have arcuate ends. The grate is supported by cast iron legs removably secured to the grate at the corners thereof.

In U.S. Pat. No. 4,163,442 to R. O. Welty there is disclosed a fireplace heat system for extracting heat from a fire in a fireplace comprising a plurality of U-shaped structure means, each of said U-shaped structure means including two opposing substantially parallel horizontal legs of thick wall malleable black iron pipe and including threads on each end of each of said legs, plurality of substantially vertical connecting members of said black pipe and including threads on each end, and two pluralities of pipe elbows of said black pipe, each of said pipe elbows threaded onto each threaded end of said connecting member and one threaded end of each of said opposing legs, air input manifold means connecting bottom legs of each of said plurality of U-shaped structure means together, said air input manifold means including plurality of alternating tees and nipples of said black pipe screwed together, said plurality of tees being one greater than said plurality of nipples, a plug of said black pipe screwed into the furthest end of said last tee, and said bottom legs of each of said plurality of U-shaped structure means connected to the bottom leg of each of said tees, forced air input means connected to closet end of said first tee of said air input manifold means including a street elbow of said black pipe connected to the closest end of said first tee of said air input manifold means, one end of a hose connected to said street elbow with a hose clamp, and the other end of said hose connected to a blower with a hose clamp, said blower exhausting high velocity turbulent air into said pipes at a high velocity into said air input manifold means, said plurality of pipe caps of said black pipe including circular holes in said respective pipe caps and screwed onto said furthest threaded ends of top legs of said plurality of U-shaped structure means from said forced air means whereby said pipe caps restrict and balance the air flow over said U-shaped structure means, and turbulence is produced to maximize heat transfer from the fire in the fireplace to the environment adjacent the fireplace by the rough interior diameter as well as the exterior diameter of said thick wall malleable black iron pipe, by the boundary layers of air between said U-shaped structure means and said air input manifold means, by the air entering the bottom pipes of said plurality of U-shaped structure means, and by the forcing of the high velocity air around from said air input manifold means to said plurality of U-shaped structure means, and by the forcing of the high velocity air around the plurality of angles of said pipes at said tees and elbows from said air input manifold means to said plurality of U-shaped structure means to further create turbulence thereby resulting in maximized heat transfer from the fire in the fireplace to the environment adjacent the fireplace where each of said black pipe is replaceable.

In U.S. Pat. No. 4,228,784 to D. O. Malogouris there is disclosed a fireplace forced air heating apparatus, comprising an upstanding, vertically and laterally elongated heat exchanger contoured and dimensioned for placement adjacent the rear wall of a fireplace and enclosing a plenum, a pair of tubes connected to the heat exchanger adjacent to the bottom and lateral sides thereof and communicating at their inner ends with the plenum, the tubes extending horizontally forward from the heat exchanger toward the front of the fireplace, an elongated main duct disposed horizontally across and forwardly of the pair of tubes and extending laterally beyond said tubes, the ends of the main duct being open, a pair of duct segments secured at their forward ends to the rear side and intermediate the ends of the main duct for communication therewith and extending rearwardly for communication of their rearward ends with the forward ends of the pair of tubes, a pair of ports in the front side of the main duct substantially opposite the pair of duct segments, a baffle member comprising a hollow plug receivable interchangeably in either of the pair of ports for communicating the associated duct segment with the adjacent open end of the main duct, whereby to deliver cool air from said open end to the heat exchanger for heating, the baffle sleeve duct means located near the top and rear thereof whereof the velocity of the flow of air is caused to increase, openings below the heat chamber at the base of the unit and below the doors for permitting air to enter said outer enclosed sleeve duct, an opening in the top of said unit above the heat chamber for permitting heated air to flow from said outer sleeve duct means, a reduced cross-section in said sleeve duct means that causes the heated air to flow at a high velocity, means in the front of the unit for controlling the flow of air to the flow of gases and smoke from the heat chamber, sheet metal screws, panel connecting means on the top of the unit above the duct means and on the sides of the unit outside the duct means, said panel connecting means comprising of a plurality of openings in the outer surfaces of said unit adapted to receive the said sheet metal screws, each of said openings at the top and the sides thereof and being aligned equally distant from the front of the unit so that the openings in the top are aligned with the openings in the sides, flat panels, said flat panels having flanges at right angles to said panels, said flanges having openings, said flanges adapted to rest on said openings in the unit at the top and sides thereof and adapted to aline with the openings at the top and the sides of the unit aforesaid in predetermined positions, whereby sheet metal screws may secure said panels in the same plane whereby the area behind the said panels is hidden from view and whereby if the fireplace is small or large, the panels can be positioned in abutment with the face of the fireplace.

In U.S. Pat. No. 4,178,908 to C. H. Trexler there is disclosed a fireplace heating unit adapted to be supported on the hearth and fireplace floor of an existing fireplace to extend into the existing fireplace recess, comprising a housing structure having a metal furnace jacket defining a combustion chamber for receiving a fuel to be burned and metal housing means receiving said jacket, said housing means and said furnace jacket having spaced apart wall portions to provide an interior air space between said furnace jacket and said housing means, wall means forming a part of said housing structure and partitioning said interior space into a plenum and an air conduction space, said plenum overlying said furnace jacket and combustion chamber, and said air conduction space extending at least along the back of the furnace jacket, conduit means exposed in said combustion chamber and establishing fluid communication between said air conduction space and said plenum to provide for the flow of air from said conduction space to said plenum without mixing with combustion gases in said combustion chamber, a forced air blower connected to feed air to be heated to said air conduction space for flow through said air conduction space and said conduit means to said plenum, the air flowing through said air conduction space and said conduit means being heated by the fire produced by the burning of fuel in said combustion chamber whereby heated air is delivered to said plenum, said plenum having an air outlet opening to provide for the passage of the heated air from said plenum to the room area being heated, said housing structure being adapted to seat on the fireplace floor and said hearth at a location where only a rearward portion of said housing structure is received in said fireplace recess, at least a portion of said plenum and a portion of the combustion chamber vertically underlying said plenum being disposed forwardly of said rearward portion to be positioned forwardly of said fireplace recess when said rearward portion is received in receptacle mounted in housing structure, said receptacle having its open upper end disposed at the top wall of said plenum at a location where it is disposed forwardly of said fireplace recess to open into the room area being heated, said receptacle extending at least in said plenum and being exposed to the heat produced by burning fuel in said combustion chamber to provide for the vaporization of water in said receptacle.

In U.S. Pat. No. 4,140,102 there is disclosed a fireplace grate comprising a cradle portion for holding combustibles which includes a plurality of apertured, substantially identical planar segments and means including threaded means engaging said apertures for maintaining them in substantially identical orientation and in predetermined spatial relation to one another, means disposed below said cradle portion for supporting the latter, said supporting means including a selected number of substantially planar apertured segments which have substantially identical configuration to said planar segments of said cradle portion and oriented opposite to the orientation of the segments of said cradle portions, and threaded means engaging predetermined ones of said apertures for connecting said means to one another in a manually releasable mechanical manner.

In U.S. Pat. No. 4,161,168 to D. D. Cagle there is disclosed a fireplace grate comprising a lower supporting frange and a grill mounted thereon, said lower frame consisting of a transversely extending rear member and a pair of side members extending right angularly from the ends of the rear member and forming them with a U-shaped structure the front of which is entirely open between the front ends of the side members, the lower frame rear member being a tubular manifold open at one end for air input and closed at its opposite end, a plurality of tubes extending forwardly in laterally spaced parallelism from removable connection of their rear end to the manifold for receiving air therefrom and having their front ends open for discharge of said air, and said grill comprising transversely extending front and rear members connected at their ends to forwardly extending side members and forming therewith a rectangular structure the side member of which bear on the side members of the lower frame, brackets slidably hanging the front end portions of the tube from the front member of the grill, and the rear member of the grill being hinged to the main fold, whereby the tubes secure the grill down in operative portion on the lower frame and the tubes are slidable forwardly in the brackets for removal from the manifold, thereby freeing the grill swinging to upwardly tilted inoperative position facilitating removal of ashes through the open front of the low frame.

Another patent of interest is U.S. Pat. No. 4,215,671 to I. Nadolsky.

SUMMARY OF THE INVENTION

A combined grate and hot water heater for a fireplace of the type having a fire chamber and a flue, the fire chamber having a bottom wall or floor, a pair of side walls, a back wall and a top wall, the flue extending vertically upward from the fire chamber through an opening in the top wall, the combined grate and hot water heater comprising a cradle for holding combustable materials to be burned, said cradle comprising a generally rectangular frame sized and configured to fit in the fire chamber and made up of a plurality of transversely extending and longitudinally extending heavy duty cast iron or galvanized iron pipes interconnected by metal pipe couplings so as to be in fluid communication with one another and defining therein a concave shaped grill, connections for allowing water to flow into and out of the pipes constituting the cradle, and support means for supporting said cradle on the bottom wall of the fire chamber in spaced relationship therewith.

According to one feature of the invention, a water heater is provided for a fireplace which is constructed such that it also serves as a grate.

According to another feature of the invention a fireplace hot water heater is provided which utilizes the heat present in the flue of the fireplace as well as the heat in the fire chamber as a heat source.

According to still another feature of the invention a combined grate and hot water heater is provided for a fireplace which includes an arrangement for exhausting stream through the chimney of the fireplace caused by the elevated temperature to which the water may be heated.

The foregoing and other objects and advantages will appear from the description to follow. In the description, reference is made to the accompanying drawings which form a part thereof, and in which is shown, by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

The present invention is directed to a combined grate and hot water heater for use in a fireplace and more particularly to a fireplace grate which is constructed so as to follow a vessel in which water may be admitted, heated and transmitted out as well as a fuel holder for supporting combustible materials to be burned.

Figure 1:
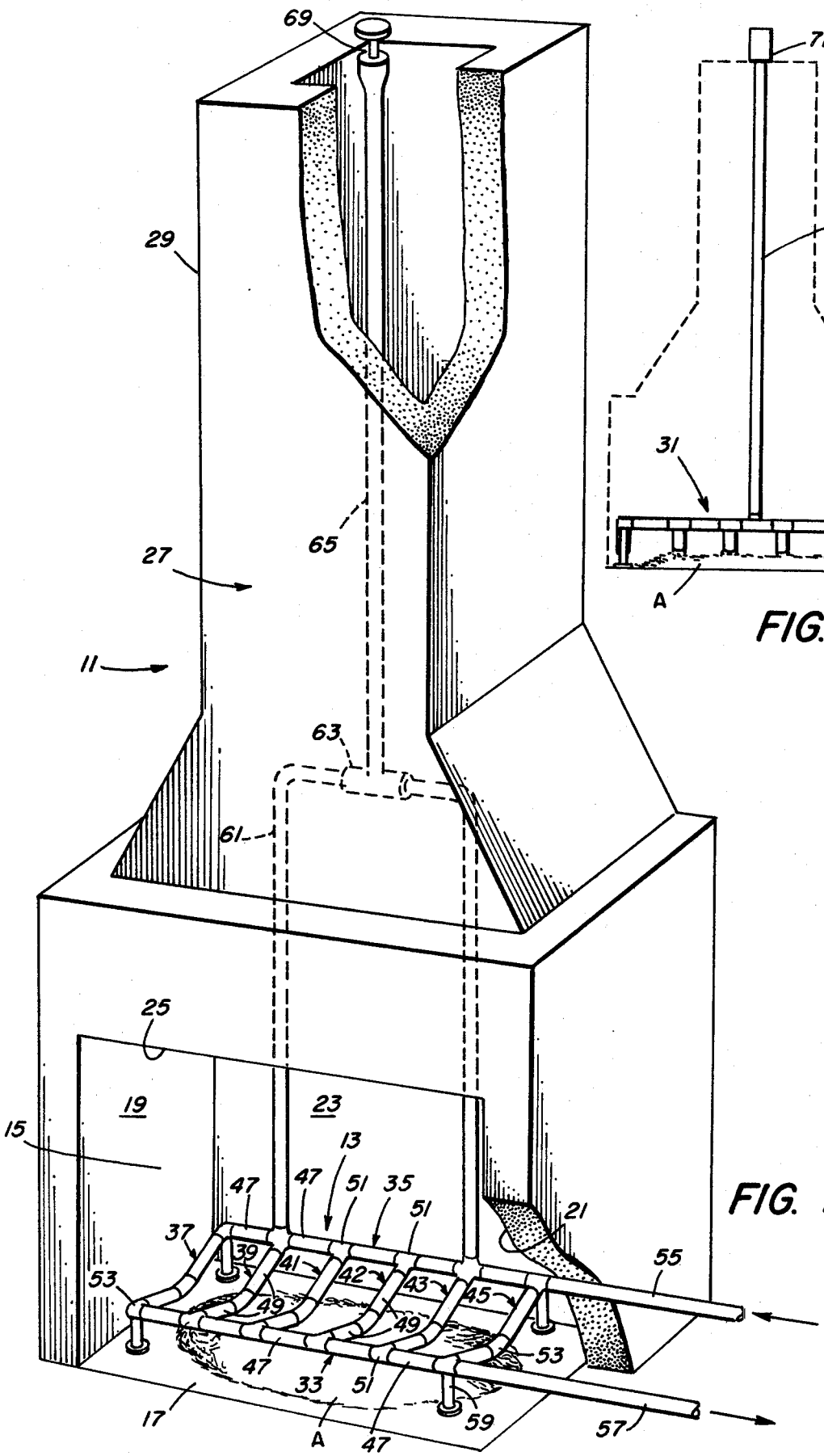
FIG. 1 is a perspective view of an embodiment of a combined grate and hot water heater constructed according to the principles of the present invention and mounted in place inside a fireplace, the fireplace being shown partly broken away.

Referring now to the drawings, there is illustrated in FIG. 1 a fireplace identified generally by reference numeral 11 along with a combined grate and hot water heater constructed according to the teachings of the present invention disposed within the fireplace 11 and identified by reference numeral 13, the fireplace 11 being shown partly broken away and in section and the combined grate and hot water heater 13 being shown in perspective.

Fireplace 11 includes a fire chamber or combustion chamber 15 which is defined by a bottom wall or floor 17, a pair of side walls 19 and 21, a back wall 23 and a top wall 25. A flue 27 extends vertically upward through an opening in the top wall 25 and provides a suitable connection to a chimney 29.

The combined grate and hot water heater 13 includes a rectangularly shaped cradle 31 for holding combustible materials such as wood or coal, which are to be burned. Cradle 31 is made up of a frame type structure consisting of a pair of hollow longitudinally extending members 33 and 35 and a plurality of hollow transversly extending members 37, 39, 41, 42, 43 and 45. The longitudinally extending members include sections of pipe 47 cut to size and threaded and the laterally extending members include sections of pipe 49 cut to size and threaded. Pipe sections 47 and 49 are interconnected so as to be in fluid communication with one another by appropriate pipe couplings in the form of T's 51 and elbows 53. As can be seen, each transverse member includes a pair of pipe sections 49 connected to each other by an elbow 53 so as to provide a frame or grill having a concave configuration. Pipe sections 47 and 49 and the associated pipe couplings 51 and 53 are made of heavy duty cast iron or galvanized iron to withstand the pressure resulting therein when water passed though is heated to elevated temperatures.

An inlet pipe 55 of heavy duty cast iron or galvanized iron is connected to the cradle 31 in fluid communication with the pipes contained therein for supplying water to be heated and an outlet pipe 57 of heavy duty cast iron or galvanized iron is connected to the cradle 31 and in fluid communication therewith for transmitting the water after it has passed through the pipes in the cradle and has been heated.

Legs 59 are provided for supporting the cradle 31 on the floor 17 of the fireplace 11 in spaced apart relationship, the legs being made of heavy duty cast iron or galvanized iron and attached to the cradle by any suitable means such as bolts and nuts (not shown). The cradle 31 and legs 59 are sized so that the lower most portions of the transverse members are between around one and four inches from the floor of the fire chamber.

The combined grate and hot water heater 13 further includes an inverted U shaped pipe section 61 which is made of heavy duty cast iron or galvanized iron which is in fluid communication with the pipes in the cradle and which extends up into the flue 27 of the fireplace 11, a pressure relief value 63 which is connected to and in fluid communication with the inverted U shaped pipe section 61, an extension pipe 65 which is coupled to the pressure relief valve 63 and which extends out through the chimney 29 of the fireplace 11 and a bleeder valve 69 which is coupled to the uppermost end of the extension pipe 65.

The U shaped pipe section 61 serves to increase the overall volume of water which may be circulated within the fireplace 11 at one time and also serves to utilize the heat present in the flue 27 for further heating the water being circulated through the fireplace 11. The pressure relief valve 63 provides a means for relieving and exhausting steam or excessive pressure which may be built up within the combined grate and hot water heater 13 due to the intensity of heat generated in the fireplace 11 on burning of the combustible materials. The extension pipe 65 enables the steam so generated to exit through the chimney 29 of the fireplace 11 and the bleeder valve 69 serves to prevent unwanted materials from passing down into the pipes containing the water.

Figure 2:
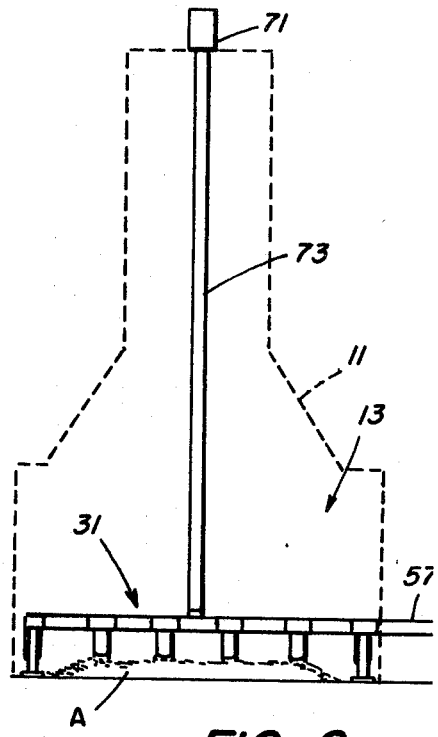
FIG. 2 is a front view (reduced in size) of another embodiment of a combined grate and hot water heater constructed according to the teachings of the present invention and disposed inside a fireplace, the fireplace being shown in phantom.

Referring now to FIG. 2 there is illustrated another embodiment 70 of the invention. In this embodiment the U-shaped pipe section is eliminated and a pressure relief valve 71 is located on top of the chimney and connected directly to the cradle 31 through an extension pipe 73.

The operation of the combined grate and hot water heater should be readily apparent from the preceeding description.

In the use of the combined grate and hot water heater 13, fuel such as coal or wood is placed in the cradle 31 and a fire started. Water to be heated is then admitted through the water supply inlet 55. The intense heat produced by the fire in the fire chamber and flue will heat the water as it is circulated through the pipes and the heated water will exit through the outlet pipe 57. Since the transverse pipe sections are relatively close to the floor of the fire chamber, falling ashes (A, see FIG. 2) accumulating on the floor and containing heat will contact the pipe sections and provide additional heat for heating the water contained therein.

It is to be noted that the size (i.e. diameter) of the pipes used in the combined grate and hot water heater of this invention may vary according to the overall dimensions of the cradle portion of the unit. For example if the cradle portion is 14" by 18" the pipe sections are preferably 1½", if the dimensions of the cradle portion are 18" by 21" the pipe sections are preferably 2" and if the dimensions of the cradle portion are over 18" by 21" the pipe sections are preferably 2½".

While it is contemplated that the invention may be utilized to convey water to heaters of any desired form, such as radiators or pipes within floor slabs or other construction, it may also be used in generation of hot water supplies for use at homes and the like.

While embodiments of the invention have been described using specific terms, such description is for illustrative purposes only, and it is to be understood that changes and variations may be made without departing from the spirit and scope of the following claims.

What is claimed is:

1. A combined grate and hot water heater for a fireplace of the type having a fire chamber, a chimney and a flue, the fire chamber having a bottom wall or floor, a pair of side wall, a back wall and a top wall, the flue extending vertically upward from the fire chamber through an opening in the top wall through the chimney, the combined grate and hot water heater comprising:

a. a cradle for holding combustible materials to be burned, said cradle comprising a generally rectangular frame sized and configured to fit in the fire chamber and made up of a plurality of transversely extending and longitudinally extending heavy duty cast iron or galvanized iron pipes interconnected by metal pipe couplings so as to be in fluid communication with one another and defining therein a concave shaped grill.

b. connections for allowing water to flow into and out of the pipes constituting the cradle, and c. legs for supporting said cradle on the bottom wall of the fire chamber in spaced relationship therewith, d. said cradle and legs being sized and configured so that portions of at least some of the pipes in the cradle are between around one and four inches from the bottom wall of the fireplace so as to contact ashes accumulating on the bottom wall of the fireplace on burning of the combustible materials, e. a pressure relief valve in fluid communication with said metal pipes for exhausting and relieving steam and/or excessive pressure built up within said pipes on burning of said combustible materials, and f. an extension pipe connected in fluid communication with said metal pipes in said cradle and extending vertically upward through said flue and said chimney so as to enable the steam so generated to exit through the chimney and wherein said pressure relief valve is coupled to one end of the extension pipe.

2. The combined grate and hot water heater of claim 1 and wherein said pressure relief valve is coupled to the top end of said extension pipe and located above said chimney.

3. The combined grate and hot water heater of claim 1 and further including an inverted U shaped pipe section in fluid communication with said pipes in said cradle and extending vertically upward into said flue so as to utilize the elevated temperature in the flue as a source of heat for heating the water.

4. The combined grate and hot water heater of claim 3 and wherein said pressure relief value is in said flue and connected between the inverted U shaped pipe and the lower end of the extension pipe and wherein said combined grate and hot water heater further includes a bleeder valve located above said chimney and connected to the upper end of said extension pipe.

* * * * *